United States Patent [19]

Fujita

[11] 4,407,587

[45] Oct. 4, 1983

[54] ELECTRONIC TIMER

[75] Inventor: Masanori Fujita, Tokyo, Japan

[73] Assignee: Seikosha Co., Ltd., Tokyo, Japan

[21] Appl. No.: 403,430

[22] Filed: Jul. 30, 1982

Related U.S. Application Data

[63] Continuation of Ser. No. 156,420, Jun. 4, 1980, abandoned.

[30] Foreign Application Priority Data

Jun. 11, 1979 [JP] Japan ..... 54-73299

[51] Int. Cl.[3] ..... G04F 8/00; G04C 17/02

[52] U.S. Cl. ..... 368/108; 368/240

[58] Field of Search ..... 368/82, 84, 107–113, 368/239–242

[56] References Cited

U.S. PATENT DOCUMENTS 4,209,974 7/1980 Noble ..... 368/84

4,246,650 1/1981 Moritani et al. ..... 368/69

*Primary Examiner*—Vit W. Miska

*Attorney, Agent, or Firm*—Robert E. Burns; Emmanuel J. Lobato; Bruce L. Adams

[57] ABSTRACT

A plurality of liquid crystal display elements are radially arrayed, display elements corresponding to preset time are kept turned on, and lapse of time is successively and selectively displayed, so that the remaining time and the lapse of time can be quickly recognized from a mutual relation between the lapse of time and the preset time. Furthermore, the display elements are divided into two in the radial direction so that the preset time and the lapse of time can be displayed by the display elements which have been divided. Moreover, the time display unit displays the time in a flashing manner, such that the lapse of time and the like can be recognized more easily.

8 Claims, 25 Drawing Figures

FREQ DIVIDER
XTAL OSC
FREQ DIVIDER
DOWN-COUNTER
STORAGE CKT
DOWN-COUNTER
STORAGE CKT
PULSE GEN
SELECTION CIRCUIT
SELECTION CIRCUIT
DECODER
DECODER
OUTPUT CONVERSION CIRCUIT
DISCRIMINATOR CKT
SEGMENT VOLTAGE SUPPLY CIRCUIT
COMMON VOLTAGE SUPPLY CIRCUIT
SWITCHING CIRCUIT
11
10
12
13
15
14
16
17
18
19
20
21
22
23
24
24a
25
25a
25b
26
26a
27
27a
28
29
p2
p1
d0
d9
d0
d5
w1
w2
e0
e9
c0
c5

ELECTRONIC TIMER

This is a continuation of application Ser. No. 156,420, filed June 4, 1980, and now abandoned.

BACKGROUND OF THE INVENTION

The present invention relates to an electronic timer comprising a display device which is made up of optical display elements in the shape of hands which are radially arrayed.

In the conventional timers which measure the time preset in a counter and which successively subtract a unit time from the preset time to report the time when the preset time is reached, it is accepted practice to display the remaining time so that the passage of time can be observed. Therefore, in a case where the time has passed the preset time, it is difficult to quickly know at a glance from the timer what interval of time has passed.

SUMMARY OF THE INVENTION

A first object of the present invention is to provide a new electronic timer employing a display device which comprises optical display elements in the shape of hands which are arrayed in a radial manner.

A second object of the present invention is to provide an electronic timer which displays a preset time by means of optical display elements in the shape of a hand, which are radially arrayed, which displays the passage of time relative to the preset time by successively turning on a display element to be displayed with an elapsing time, so that the elapsing time can be confirmed at any time from mutual display positions between display elements which display the remaining time and the preset time.

A third object of the present invention is to provide an electronic timer which displays the preset time by means of optical display elements in the shape of a hand, that are radially arrayed, which successively displays the passage of time relative to the preset time by means of the display elements, and which flashes at least either one group of the above-mentioned display elements so that the display of time can be recognized at a glance.

A fourth object of the present invention is to provide an electronic timer in which the outer display elements and the inner display elements are arrayed in a plurality of numbers in a radial manner, and the remaining time and the preset time are displayed by at least either the outer display elements or the inner display elements, to increase the freedom of display.

BRIEF DESCRIPTION OF THE DRAWINGS

The nature of the present invention as well as other objects and advantages thereof will become more apparent from the following description in conjunction with the accompanying drawings in which:

FIGS. 2 and 3 are cross-sectional views of a liquid crystal display device illustrating mutual relations among the electrodes, in which FIG. 2 is a plan view of transparent and divided common electrodes and the associated lead wires which are formed on a glass surface that constitutes a liquid crystal display device of the present invention; FIG. 3 is a plan view illustrating, in a partly omitted manner, transparent segment electrodes formed on the glass surface to correspond to the divided common electrodes, and the wiring for the segment electrodes;

FIGS. 16 and 17 illustrate electrode patterns for constituting the liquid crystal display device according to a fifth embodiment of the present invention, in which FIG. 16 is a plan view of transparent and divided electrodes that are formed on a glass surface; FIG. 17 is a diagram showing, in a partly omitted manner, the transparent segment electrodes formed on the glass surface, and the wiring for conductively connecting the electrodes;

PREFERRED EMBODIMENTS OF THE INVENTION

Figure 1:
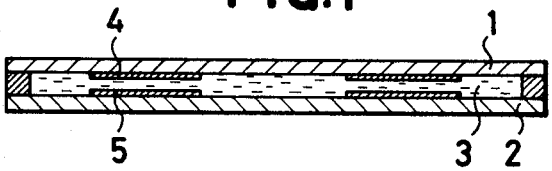
FIG. 1 is a diagram illustrating a portion according to an embodiment of the present invention.
Figure 2:
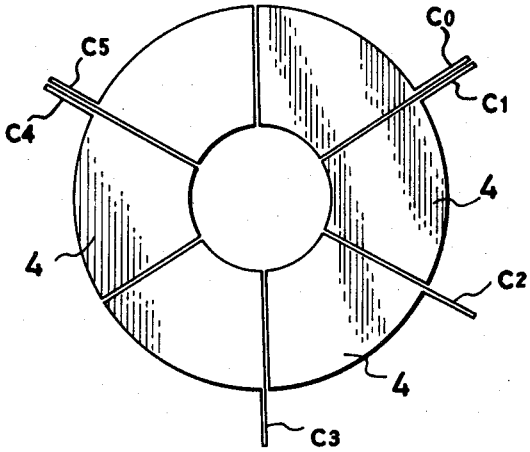
Figure 3:
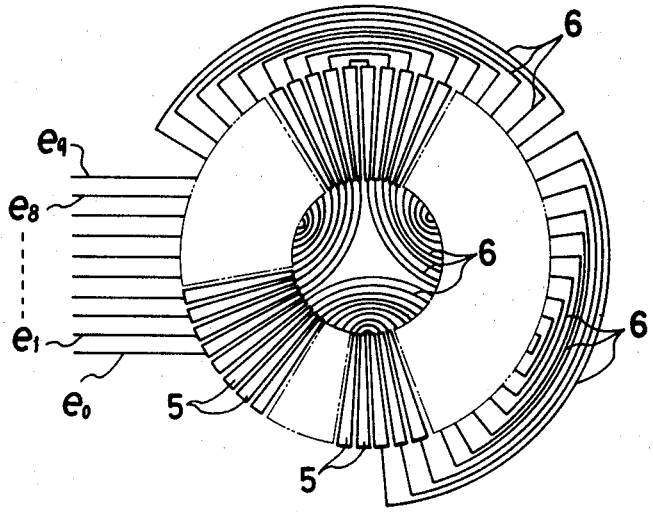

An embodiment of the present invention is illustrated below with reference to the drawings. FIG. 1 illustrates a display device which displays the time. The display device comprises two pieces of sealing glasses 1, 2 which are opposed to each other maintaining a predetermined gap to contain a liquid crystal 3. On the inner surface of the sealing glass 1 are formed six fan-shaped common electrodes 4, . . . 4 as shown in FIG. 2. Terminals $C_0$ to $C_5$ are lead out from the common electrodes. On the inner surface of the sealing glass 2 are formed 60 segment electrodes 5, . . . 5 in a circular manner to face to the common electrodes 4, . . . 4 as shown in FIG. 3. Segment electrodes 5 at predetermined positions are successively connected by lead electrodes 6, and are connected to ten terminals $e_0$ to $e_9$.

Figure 4:
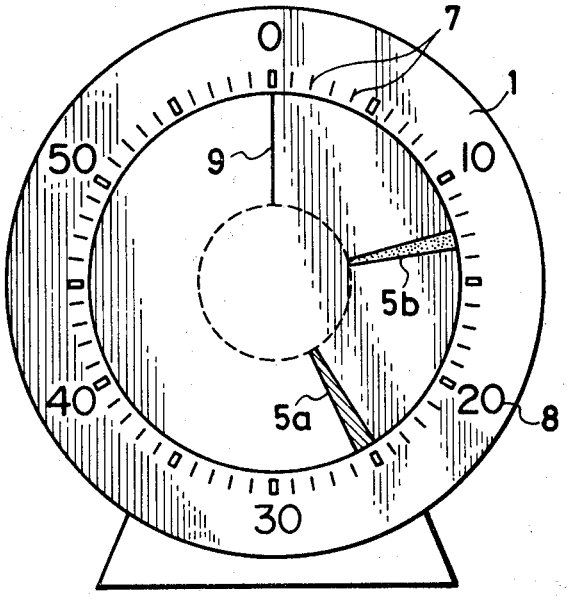
FIG. 4 is a front view of a timepiece illustrating the mode of display according to the first embodiment of the present invention.

FIG. 4 is a front view of a 60-minute timer having on the dial graduations 7, . . . 7 which divide the circumference into 60 equal segments, numerals 8 for indicating minutes, and a line 9 for indicating when counting of the time is completed.

Figure 5:
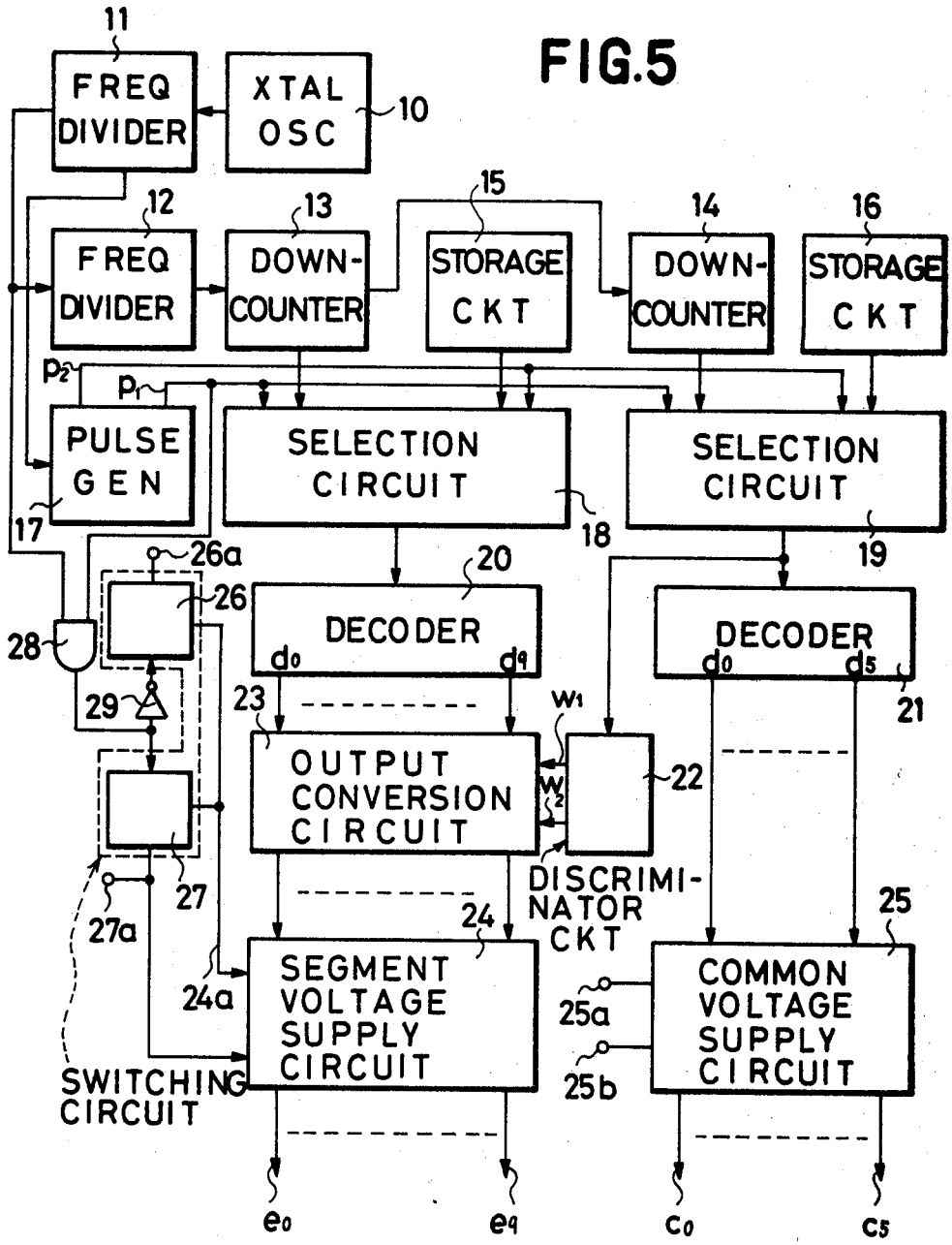
FIG. 5 is a block diagram of a circuit for driving the timepiece of FIG. 4.

The electric circuit for displaying the time is constructed as described below. Referring to FIG. 5, the output of a crystal oscillator 10 is converted into pulse signals of a period of one minute through frequency dividers 11 and 12. The pulse signals are applied to a down-counter 13 of the presetting type which is capable of setting time data of the one digit, and a borrow output of the down-counter 13 is applied to a down-counter 14 of the presetting type which is capable of setting the time data of the ten digit. With reference to the preset time, the one minute digit signals are set in a storage circuit 15, and the ten minute digit signals are set in a storage circuit 16. One output of the frequency divider 11 is applied to a pulse generator 17, whereby timing pulses are formed depending upon the pulse being applied, and appear at the terminals $P_1$ and $P_2$ thereof. Pulses which are successively generated at the terminals $P_1$ and $P_2$ are applied to selection circuits 18 and 19 comprising gate circuits.

The selection circuit 18 alternately selects the respective outputs of the down counter 13 and the storage circuit 15 on receipt of the pulses $P_1$ and $P_2$. The selection circuit 19 alternately selects the respective outputs of the down counter 14 and the storage circuit 16 on receipt of the pulses $P_1$ and $P_2$. A discriminator circuit 22 produces a signal for changing the order of the input and output data of an output conversion circuit 23, depending upon whether the output data of a selection circuit 19 fed to a decoder 21 is of an even number or an odd number. The output of the output conversion circuit 23 causes a segment voltage supply circuit 24 to produce predetermined outputs at the terminals $e_0$ to $e_9$. The output of the decoder 21, on the other hand, causes a common voltage supply circuit 25 to produce predetermined output voltages at the terminals $C_0$ to $C_5$. Switching circuits 26, 27 constructed of analog switches receive an output of an AND gate circuit 28, whereby either one of them is closed or opened; either one of the voltages applied to terminals 26*a* and 27*a* is produced. The AND gate circuit 28 produces an output when it has received a pulse of the frequency divider 11 and a pulse generated at the terminal $P_1$ of the pulse generator 17. The output level of the AND gate circuit 28 is inverted by an inverter 29 and is then fed to the switching circuit 26.

Figure 6:
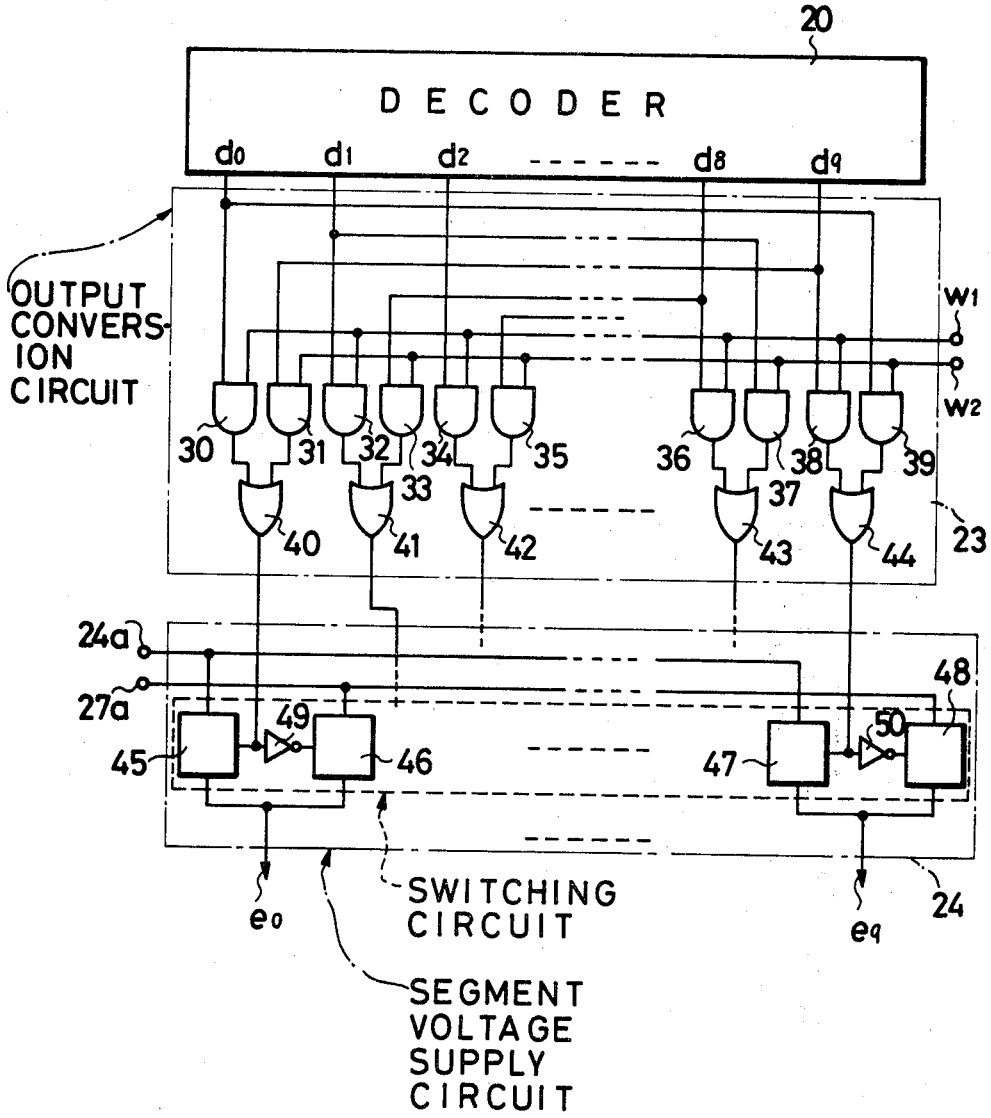
FIG. 6 is a circuit diagram illustrating in detail the major portions of FIG. 5.

FIG. 6 mainly illustrates a detailed circuit diagram of the output conversion circuit 23 and the segment voltage supply circuit 24. The outputs of the decoder 20 are fed to switching circuits 45 to 47 constructed of analog switches via AND gate circuits 30 to 39 and OR gate circuits 40 to 44, and to switching circuits 46, 48 via inverters 49, 50.

The operation will be described below. The pulse generator 17 of FIG. 5 alternately produces through its terminals $P_1$ and $P_2$ pulses of a frequency of 128 Hz to display the preset time and the remaining time in a time-divisional manner. When a pulse at the terminal $P_1$ is fed to the selction circuits 18 and 19, which select the contents in the down counters 13 and 14, respectively, and the selected respective contents are supplied to the decoders 20, 21, respectively. On the other hand, when a pulse at the terminal $P_2$ is fed to the selection circuits, which select the preset time data in the storage circuits 15 and 16, the selected respective time data is fed to the decoders 20 and 21, respectively. In response to date from the selection circuit 18 respective data of 0 to 9 minutes are successively fed to the decoder 20, which successively produces a logic "1" at a corresponding terminal among the terminals $d_0$ to $d_9$, and is produced a logic "0" at the remaining terminals when a logic "1" produces at any one of the terminals $d_0$ to $d_9$. For example, when the input data to the decoder 20 is 3 minutes, a logic "1" is produced at the terminal $d_3$, and at the remaining terminals $d_0$ to $d_2$ and $d_4$ to $d_9$ is produced a logic "1". The decoder 21 works in the same manner as the decoder 20, namely when the data represents a time less than 10 minutes and in the range from 10 minutes to 50 minutes, a corresponding terminal among the terminals $d_0$ to $d_5$ produces a logic "1".

On the other hand, when the 10 minutes data is an even number, a logic "1" appears at a terminal $w_1$ of the discriminator circuit 22 and when the 10 minutes digit data minutes is of an odd number, a logic "1" is produced at a terminal $w_2$ of the 10 minutes digit discriminator circuit 22. Therefore, when the data is 0, 2, 4, 6 or 8, the AND gate circuit 30, 32, 34, 36 or 38 of FIG. 6 is opened, whereby the output of the switching circuit is produced at the terminals $e_0$ to $e_9$ being selected by the output from the terminals $d_0$ to $d_9$ of the decoder 20. When the 10 minutes digit data is of an odd number, the AND gate circuit 31, 33, 35, 37 or 39 is opened, and the output of the switching circuit is produced at the terminals $e_9$ to $e_0$ being selected by the output from the terminals $d_0$ to $d_9$ of the decoder 20.

Figure 7:
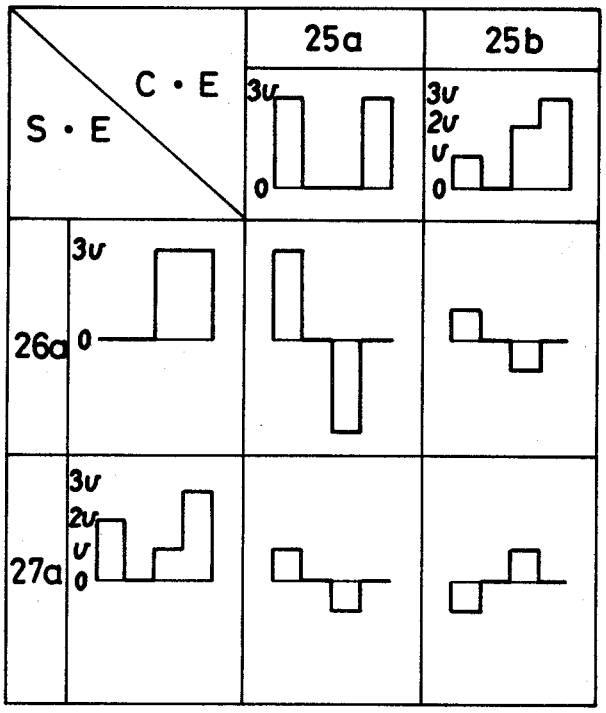
FIG. 7 is a diagram showing voltage wave forms which are applied to the common electrodes and to the segment electrodes, as well as across the electrodes of the two groups.

Responsive to the outputs of the output conversion circuit 23 and the decoder 21, the segment voltage supply circuit 24 and the common voltage supply circuit 25 produce the following outputs. First, assuming that pulses shown in FIG. 7 are fed to the input terminals 26*a*, 27*a* of the switching circuits 26, 27 and to the input terminals 25*a*, 25*b* of the common voltage supply circuit 25, which are illustrated in FIG. 5.

The liquid crystal according to this embodiment turns on when a voltage |3V| is periodically applied, and turns off when a voltage |1V| is periodically applied. Therefore, the liquid crystal is turned on when the common electrode receives a pulse from the terminal 25*a* and the segment electrode receives a pulse from the terminal 26*a*, and is turned off in all other cases. The operation described below is with reference to a pulse fed to the segment electrode. When any one output from the output conversion circuit 23 is a logic "0", a pulse appears on the terminal 27*a* is fed to the segment electrode via a switching circuit selected from among the switching circuits 46 to 48 of FIG. 6. When any one output from the output conversion circuit 23 is a logic "1", a pulse appears on the terminal 24*a* is fed to the segment electrode via a switching circuit selected from among the switching circuits 45 to 47.

Pulses produced on the terminal 24*a* are described below. Namely, with reference to FIG. 5, the output of the AND gate circuit 28 remains a logic "0", while pulses are being generated at the terminal $P_2$ of the pulse generator 17, whereby pulses that are applied to the terminal 26*a* are applied to the terminal 24*a* via the switching circuit 26. When any one pulse is generated at the terminal $P_1$, pulses produced at the terminal 27*a* and pulses at the terminal 26*a* are alternately produced at an interval of one second at the terminal 24*a* because pulses of 1 Hz are fed to the AND gate circuit 28 from the frequency divider 11.

On the other hand, when any one output of the decoder 21 is a logic "1", the common voltage supply circuit 25 produces a pulse applied to the terminal 25*a* at any selected output terminal thereof, and when any one output of the decoder 21 is a logic "0", the common voltage supply circuit 25 produces a pulse applied to the terminal 25*b* at any selected output terminal thereof.

For example, assuming that a preset time of 25 minutes is indicated by a display element 5*a* and a remaining time of 13 minutes is indicated by a display element 5*b*, as shown in FIG. 4, under this state when pulses are periodically produced at the terminal $P_1$ of FIG. 5, pulses applied to the terminals 26*a* and 27*a* respectively are alternately produced at the terminal $e_6$ of the segment voltage supply circuit 24 and pulses applied to the terminal 27*a* produced at all other terminals except the terminal $e_6$.

On the other hand, pulses applied to the terminal 25*a* produced at the terminal $C_1$ of the common voltage supply circuit 25 and pulses applied to the terminal 25*b* produced at all other terminals except the terminal $C_1$. Accordingly, the display elements 5*b* flashes to display the remaining time of 13 minutes.

Then, when any one pulse generated at the terminal $P_2$, pulses applied to the terminal 26*a* produced at the terminal $e_5$ of the segment voltage supply circuit 24, and pulses applied to the terminal 27*a* produced at all other terminals except the terminal $e_5$. On the other hand, the terminal $C_2$ of the common voltage supply circuit 25 produces pulses applied to the terminal 25*a*, and other terminals produce pulses applied to the terminal 25*b*. Therefore, the display element 5*a* is turned on to display the set time of 25 minutes.

Figure 8:
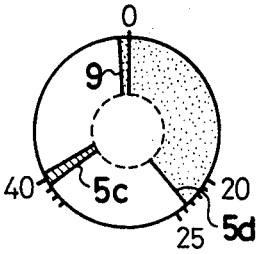
FIG. 8 is a diagram illustrating the state of a display according to a second embodiment of the present invention.

FIG. 8 illustrates another embodiment in which a display element 5*c* to display a preset time is turned on, and display elements from a display element 5*d* to an index line 9 are flashed. The embodiment of FIG. 8 is indicating that the time has been set to 40 minutes and the remaining time is 23 minutes.

Figure 9:
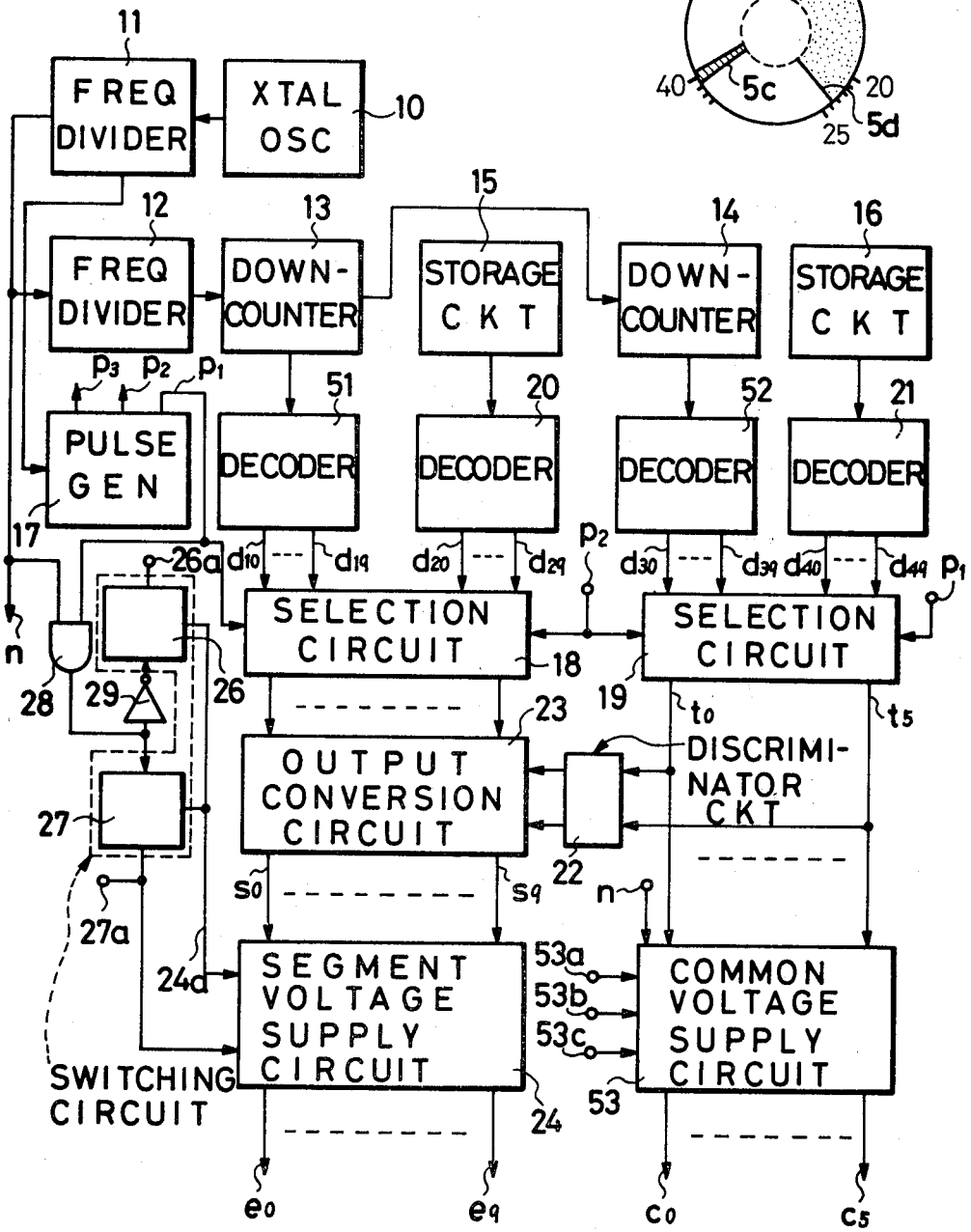
FIG. 9 is a block diagram of the circuit for effecting the display of FIG. 8.
Figure 10:
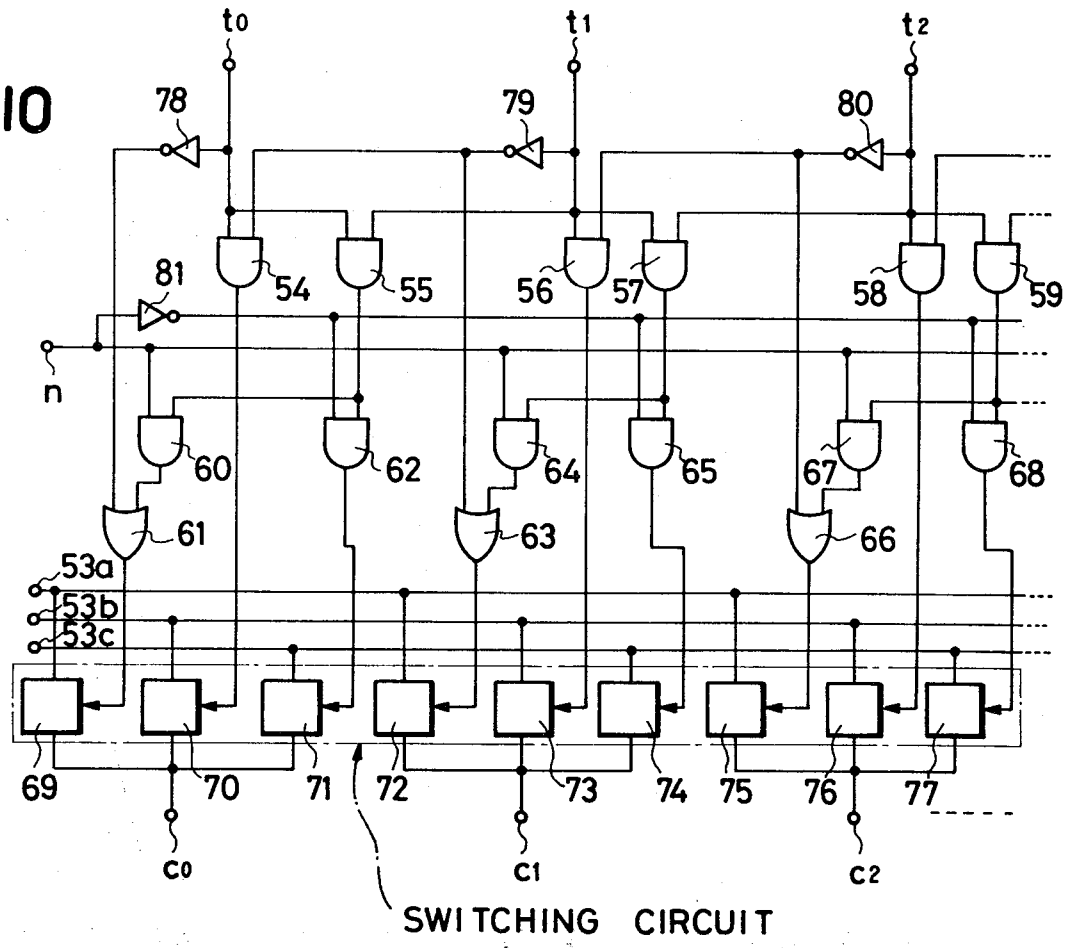
FIG. 10 is a circuit diagram illustrating in detail the major portions of FIG. 9.

FIG. 9 shows a circuit for effecting the above-mentioned display, and in which the decoders 51, 52 and common voltage supply circuit 53 are different from those of FIG. 5. The decoders 51, 52 produce outputs for displaying the remaining times in a cumulative manner. When the contents of the counter 13 are 0, 1, . . . 8, 9, the decoder 51 is so constructed that the outputs are "1" at the terminals $d_{10}$, ($d_{10}$, $d_{11}$), . . . ($d_{10}$ . . . $d_{18}$), ($d_{10}$ . . . $d_{19}$), respectively. The decoder 52 also works in the same manner. FIG. 10 illustrates in detail a portion of the common voltage supply circuit 53, in which reference numerals 54 to 60, 62, 64, 65, 67 and 68 denote AND gate circuits, 61, 63 and 66 denote OR gate circuits, 69 to 77 denote switching circuits, and 78 to 81 denote inverters. Reference numerals that are the same as those of FIG. 5 denote blocks having the same functions as those of FIG. 5. Though there is shown only a part of a whole circuit of the common voltage supply circuit 53, it is for the reason that the same circuits as provided for the terminal $t_1$ or $t_2$ are also provided for the terminals $t_3$ and $t_4$ except for the final terminal $t_5$. Namely, there is provided for the terminal $t_3$ or $t_4$ the same circuit consisting of the AND gate circuits 58, 59, 67 and 68, OR gate circuit 66, switching circuit 75, 76 and 77 as are provided for the terminal $t_2$. A circuit configuration for the terminal $t_5$ is different from the circuit provided for the terminal $t_1$ to the terminal $t_4$. The circuit configuration consists of two switching circuits one of which receives pulses produced at the terminal 53*b* and is switched ON and OFF by directly receiving an output from the terminal $t_5$, the other receives pulses produced at the terminal 53*a* and is switched ON and OFF by an output from an inverter from the terminal $t_5$. The respective output terminals of two switching circuits are connected in common and the common terminal is connected to the terminal $C_5$. With respect to the above circuit configuration, to explain its structure on the basis of the circuit provided for the terminal $t_2$, assume that the terminal $t_5$ is substituted for the terminal $t_2$, the AND gate circuits 58, 59, 67 and 68, OR gate circuit 66 and switching circuit 77 are removed, an output from the terminal $t_5$ is directly fed to the switching circuit 76 and is fed via the inverter 80 to the switching circuit 75.

First, the operation for displaying the remaining time in a flashing manner is described below with reference to the case when the time of 23 minutes is to be displayed as shown in FIG. 8. In this case, the contents of the counters 14, 13 of FIG. 9 are 2 and 3, respectively, whereby a logic "1" is produced at the terminals $d_{30}$ to $d_{32}$ of the decoder 52 and at the terminals $d_{10}$ to $d_{13}$ of the decoder 51.

When pulses are periodically generated at the terminal $P_1$, the outputs of the decoders 51 and 52 are selected, so that a logic "1" is produced at the terminals $t_0$ to $t_2$ of the selection circuit 19. Here, the output of the discriminator circuit 22 causes the output of the decoder 51 to be directly produced by the output conversion circuit 23, so that the output terminals $s_0$ to $s_3$ produce a logic "1". Since the terminals $t_0$ to $t_2$ assume a logic "1", the AND gate circuits 55, 57 of FIG. 10 produce a logic "1". Further, since the terminal $t_3$ assumes a logic "0", the AND gate circuit 58 produces a logic "1" as will be recognized from the periodic nature of the same circuit. Moreover, since the terminal n is fed with pulses of 1 Hz from the frequency divider 11 of FIG. 9, the AND gate circuits 60, 64 and the AND gate circuits 62, 65 open alternately maintaining a period of 1 second.

Therefore, the switching circuits 69, 71 are alternately turned on, and the switching circuits 72, 74 are alternately turned on, such that pulses from the terminals 53*a*, 53*c* are alternately generated at the terminals $C_0$, $C_1$.

Figure 11:
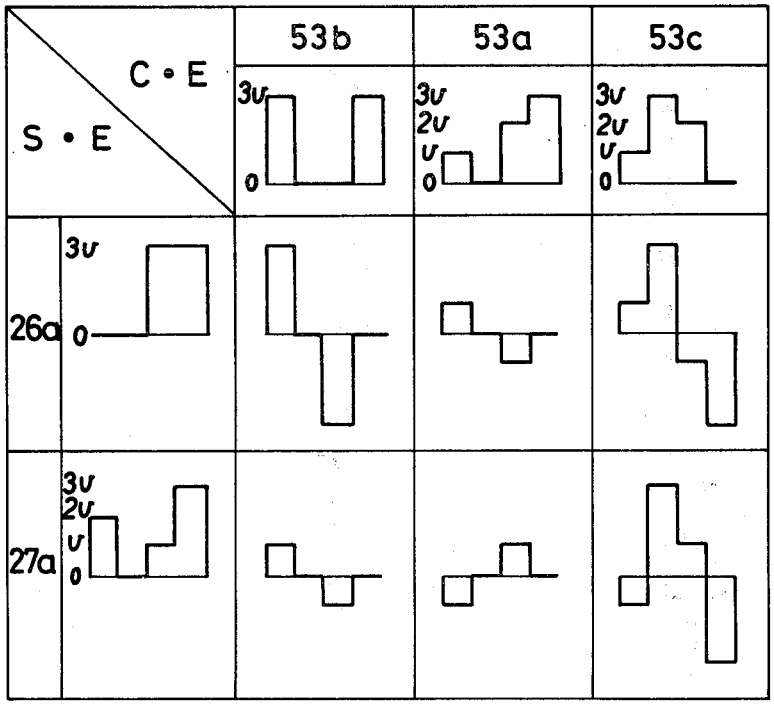
FIG. 11 is a diagram of voltage wave forms applied to the common electrodes and to the segment electrodes of the electric circuit of FIG. 9, as well as across the electrodes of the two groups.

The terminals 53*b*, 53*a*, 53*c* are fed with pulses which are shown in FIG. 11, as the pulse is fed from the terminal 53*a* to the common electrode, the corresponding display elements are all turned off. The display elements are all turned on by receiving pulses from the terminal 53*c*. Therefore, all of the display elements of from 0 to 19 minutes corresponding to common electrodes which are connected to the terminals $C_0$, $C_1$ of FIG. 9, are flashed.

On the other hand, the AND gate circuit 58 of FIG. 10 produces a logic "1", so that the switching circuit 76 is turned on, pulses are fed from the terminal 53*b* to the terminal $C_2$, and pulses are fed from the terminal 53*a* to the terminals $C_3$ to $C_5$. Therefore, the display elements from 30 to 59 minutes corresponding to common electrodes which are connected to the terminals $C_3$ to $C_5$, are all turned off. The display state of the display elements on the order of 20 minutes is controlled by pulses which are fed to the segment electrodes. Here, since the terminals $s_0$ to $s_3$ of the output conversion circuit 23 of FIG. 9 assume a logic "1", the terminals $e_0$ to $e_3$ of the segment voltage supply circuit 24 are fed with pulses from the terminal 24*a*, i.e., alternately fed with pulses from the terminals 26*a*, 27*a* maintaining a period of one second, and the terminals $e_4$ to $e_9$ are fed with pulses from the terminal 27*a*. Therefore, the display elements of 20 to 23 minutes flash, and the display elements of 24 to 29 minutes are turned off.

As described above, the remaining time is displayed in a flashing manner as shown in FIG. 8.

With reference to the preset time, the display elements corresponding to the preset time only are turned on by the pulses which are periodically produced from the terminal $P_2$ of FIG. 9, quite in the same manner as the aforementioned embodiment.

Figure 12:
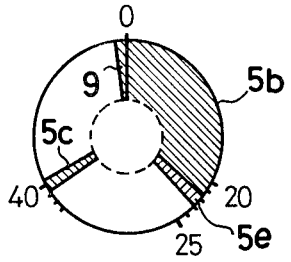
FIG. 12 is a diagram illustrating the state of a display according to a third embodiment of the present invention.

FIG. 12 illustrates a further embodiment, in which a preset time is displayed in exactly the same manner as the above-mentioned two embodiments. As for displaying the remaining time, however, the display element 5*e* at the boundary is flashed, and the display elements from the index line 9 to a display element just before the display element 5*e* is turned on.

Figure 13:
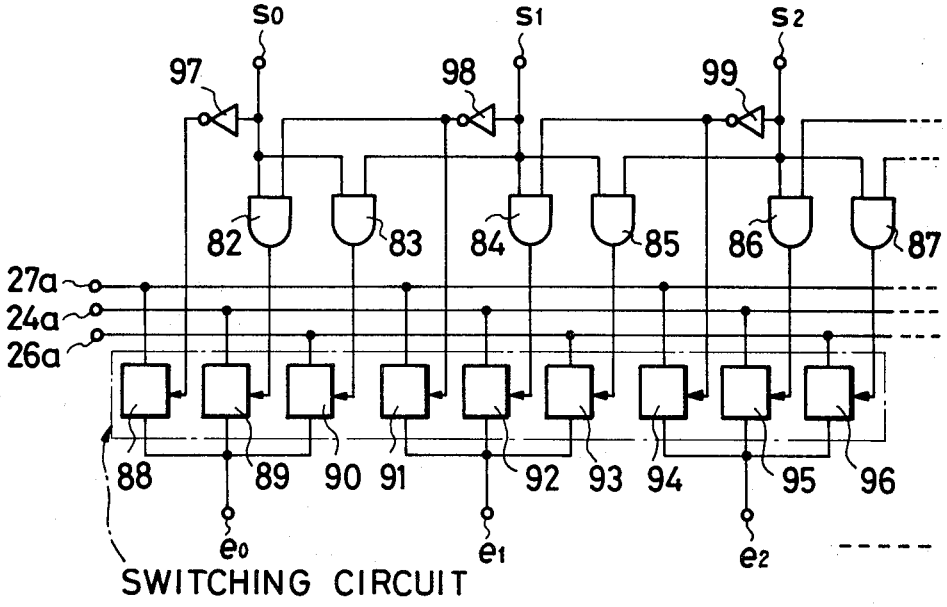
FIGS. 13 and 14 are diagrams of electric circuit illustrating in detail the major portions of FIG. 9.
Figure 14:
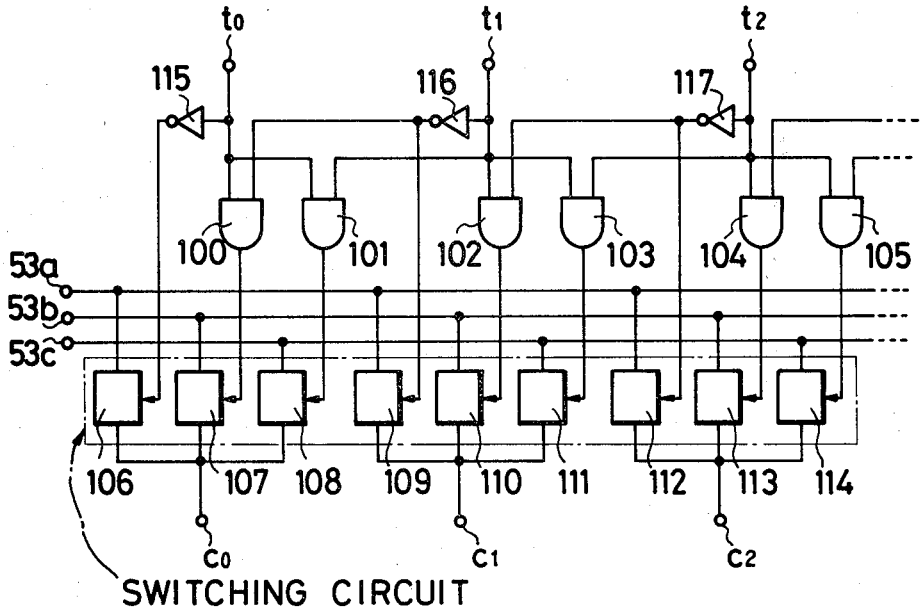

With reference to the circuit for effecting the above display, the segment voltage supply circuit 24 of FIG. 9 must be modified as shown in FIG. 13, and the common voltage supply circuit 53 must be modified as shown in FIG. 14. The circuits of FIGS. 13 and 14 are similarly constructed, in which reference numerals 82 to 87 and 100 to 105 denote AND gate circuits, 88 to 96 and 106 to 114 denote switching circuits, and 97 to 99 and 115 to 117 denote inverters. Though FIG. 13 shows only a part of a whole circuit of the segment voltage supply circuit 24, it is for the reason that the segment voltage supply circuit 24 is constructed by a repetition of the same circuit configuration as provided for the terminal of $s_1$ or $s_2$ except for a circuit provided for the final terminal $s_9$. A circuit configuration provided for the terminal $s_9$ consists of two switching circuits one of which receives pulses produced at the terminal 24*a* and is switched ON and OFF by directly receiving an output from the terminal $s_9$, the other receives pulses produced at the terminal 27*a* and is switched ON and OFF by an output which an output from the terminal $s_9$ is inverted by an inverter. The respective output terminals of two switching circuits are connected in common and the common terminal is connected to the terminal $e_9$. In FIG. 14, the abbreviated circuit configuration has also the similar circuit as mentioned in FIG. 13.

Below is illustrated the case when the remaining time of 22 minutes as shown in FIG. 12 is to be displayed relying upon the above-mentioned circuits. When pulses are periodically produced from the terminal $P_1$ of FIG. 9 in the same manner as the preceding embodiments, terminals $t_0$, $t_1$ and $t_2$ of FIG. 14 assume a logic "1". Therefore, the outputs of the AND gate circuits 101, 103 and 104 assume a logic "1", and the switching circuits 108, 111 and 113 are turned on. Therefore, the terminals $C_0$, $C_1$ produce pulses which are fed from the terminal 53*c*, so that the display elements of from 0 to 19 minutes are all turned on. Furthermore, pulses applied to the terminal 53*a* are produced at the terminals $C_3$ to $C_5$, so that the display elements of from 30 to 59 minutes are all turned off.

Furthermore, pulses applied to the terminal 53*b* are produced at the terminal $C_2$. Here, since the terminals $s_0$ to $s_2$ of FIG. 13 assume a logic "1", and the terminals $s_3$ to $s_9$ assume a logic "0", the AND gate circuits 83, 85 and 86 produce a logic "1", such that the switching circuits 90, 93 and 95 are turned on. Consequently, the terminals $e_0$, $e_1$ produce pulses which are fed from the terminal 26*a*, the terminal $e_2$ is alternately fed with pulses from the terminals 26*a*, 27*a* via the terminal 24*a* of FIG. 9, and the terminals $e_3$ to $e_9$ produce pulses which are fed from the terminal 27*a*. Accordingly, the display elements of 20 and 21 minutes are turned on, and the display element of 22 minutes flashes.

Below is mentioned the display of a preset time of 40 minutes. When pulses are generated from the terminal $P_2$ of FIG. 9, only the terminal $s_0$ of FIG. 13 and the terminal $t_4$ of FIG. 14 assume a logic "1". Therefore, the output of the AND gate circuit 82 of FIG. 13 causes the switching circuit 89 to be turned on, whereby the terminal $e_0$ produces the pulses applied to the terminal 24*a* and the terminal $e_1$ to $e_9$ produce pulses applied to the terminal 27*a*. Here, since pulses are generated from the terminal $P_2$ of FIG. 9, the terminal 24*a* produces pulses applied to the terminal 26*a*, the terminal $C_4$ produces pulses applied to the terminal 53*b*, and other terminals produce pulses applied to the terminal 53*a*. Therefore, the display element of 40 minutes only is turned on.

Figure 15:
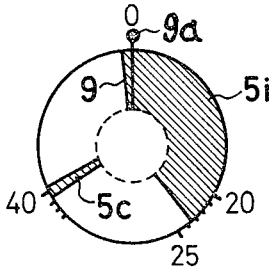
FIG. 15 is a diagram for illustrating the state of a display according to a fourth embodiment of the present invention.

Referring to still further embodiment of FIG. 15, the display element 5*c* for displaying a preset time is turned on, the display elements 5*i* comprised display elements extending between a display element representing a remaining time to index 9 are all turned on, and a second display mark 9*a* is flashed at a period of one second. This embodiment can be accomplished relying upon the same circuit construction as the preceding embodiments but so constructing the segment voltage supply circuit of FIG. 13 in the embodiment of FIG. 12 that the terminals $e_0$ to $e_9$ produce the pulses applied to the terminals 26*a*, 27*a* of FIG. 11 when the terminals $s_0$ to $s_9$ assume a logic "1" or "0".

Figure 16:
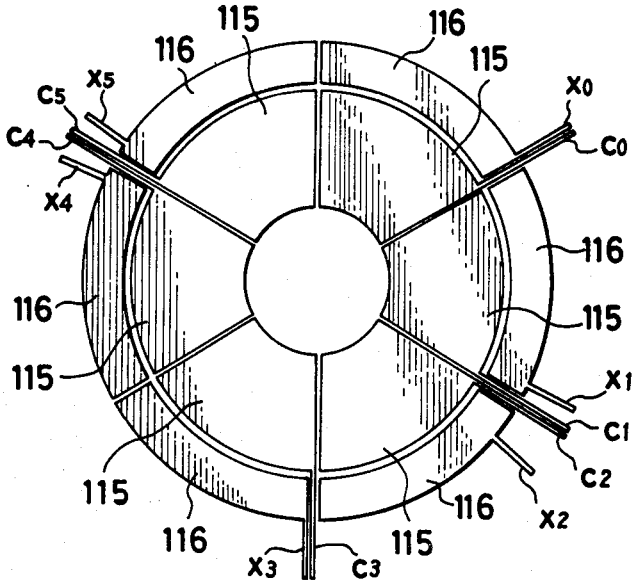
Figure 17:
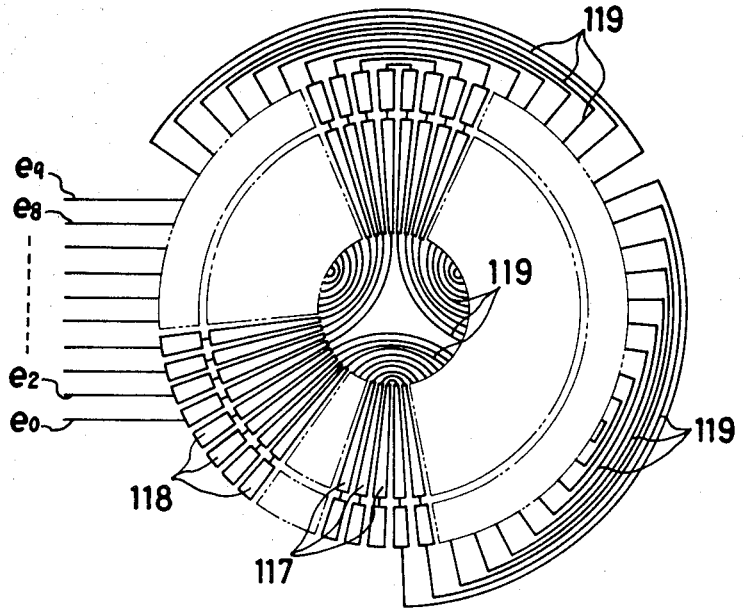

FIGS. 16 and 17 illustrate yet a further embodiment, in which common electrodes and segment electrodes are further provided on the outer side of the electrodes shown in FIGS. 2 and 3. Namely, like the embodiment of FIG. 2, the embodiment of FIG. 16 consists of six fan-shaped inner common electrodes 115 . . . 115 and six outer common electrodes 116 . . . 116 with outwardly extending terminals $x_0$ to $x_5$. With reference to FIG. 17, sixty radially arrayed inner segment electrodes 117 . . . 117 which are formed in the same manner as those of FIG. 3 correspond to the inner common electrodes 115 . . . 115. On the extension on the outer side of the inner segment electrodes 117 . . . 117 are located sixty outer segment electrodes 118 . . . 118 which face the outer common electrodes 116 . . . 116. The inner segment electrodes 117 and the outer segment electrodes 118 at predetermined positions are successively connected by lead electrodes 119 . . . 119, and are connected to ten terminals $e_0$ to $e_9$.

Figure 18:
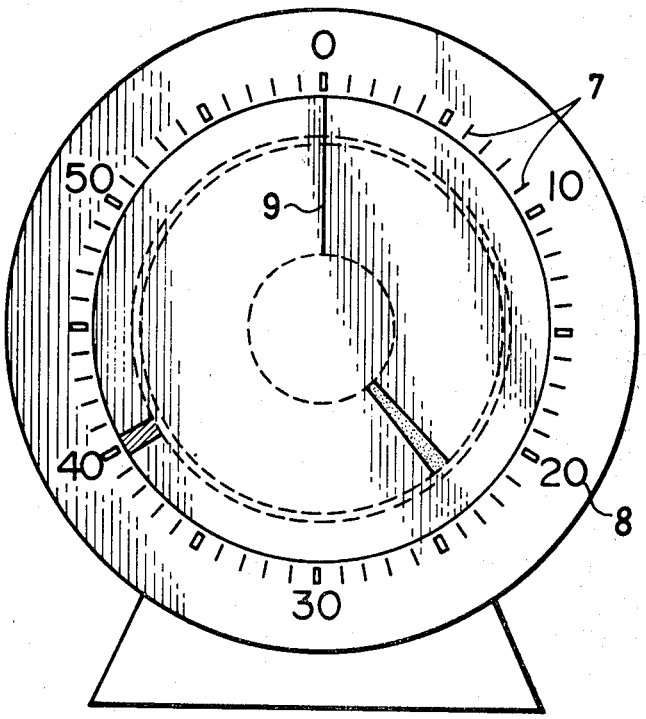
FIG. 18 is a front view of a timepiece illustrating a mode of display utilizing the above liquid crystal display device.

In FIG. 18, a preset time is displayed by the turn on of an outer display element located at a position of 40 minutes, and remaining time is displayed by the flashing of an inner display element located at a position of 23 minutes.

The circuit for effecting the display can be constructed by simply adding a circuit for driving the outer common electrodes 116 . . . 116 to the circuit of FIG. 5. The circuit for driving the outer common electrodes 116 . . . 116 may be constructed in the same manner as the circuit 25 of FIG. 5 for feeding a common voltage to the inner common electrodes 115 . . . 115. Namely, the remaining time is displayed by feeding the output of the decoder 21 to the common voltage supply circuit 25 responsive to pulses that are periodically generated at the terminal $P_1$, and the preset time is displayed by feeding the output of the decoder 21 to the outer common electrode 116 . . . 116 responsive to pulses that are periodically generated at the terminal $P_2$.

Figure 19:
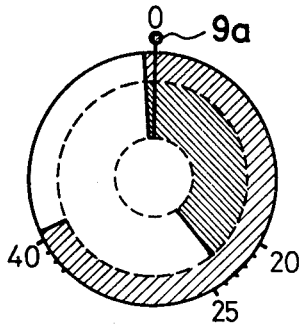
FIGS. 19 to 23 are diagrams illustrating a variety modes of display according to further embodiments of the present invention.

In FIG. 19, a preset time and a remaining time are displayed in a cumulative manner by the outer and inner display elements, and a mark 9*a* for displaying the second is flashed. In this case as each decoder for the preset time and the remaining time, there should be such a decoder that each output produced in turn from the first output terminal of the decoder to an immediate terminal before the last one is held on till the output of the last terminal is produced. The same drive circuit as used in the aforementioned embodiment which the display elements are turned on in a cumulative manner should be used for the segment electrodes, inner common electrodes and outer common electrodes.

Figure 20:
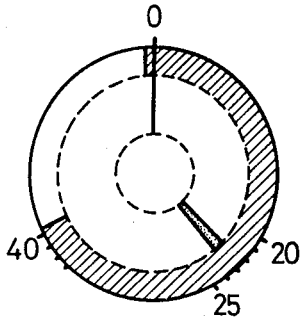

In FIG. 20, the outer display elements are turned on in a cumulative manner to display the preset time, and an inner display element corresponding to the remaining time is flashed to display the remaining time.

Figure 21:
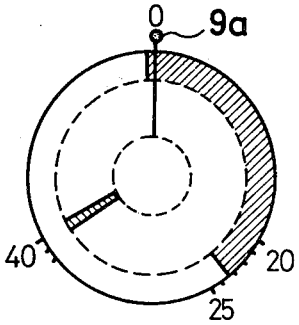

In FIG. 21, an inner display element corresponding to the preset time is turned on to display the preset time, the outer display elements are turned on in a cumulative manner to display the remaining time, and mark 9*a* for displaying the second is flashed.

Figure 22:
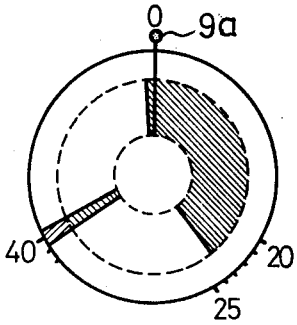

In FIG. 22, the outer and inner display elements corresponding to the preset time are turned on to display the preset time, the inner display elements are turned on in a cumulative manner to display the remaining time, and the mark 9*a* for displaying the second is flashed.

Devices of FIGS. 20 to 22 can be driven by suitably employing the circuits of the aforementioned embodiments, and are not illustrated here.

Figure 23:
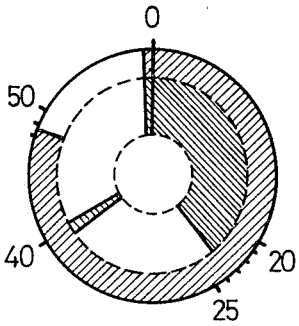

In FIG. 23, an inner display element corresponding to a preset time is turned on to display the preset time, the inner display elements are turned on in a cumulative manner to display a remaining time, and the outer display elements are cumulatively turned on to display the remaining seconds. FIG. 23 displays the preset time of 40 minutes and the remaining time of 23 minutes and 48 seconds.

Figure 24A:
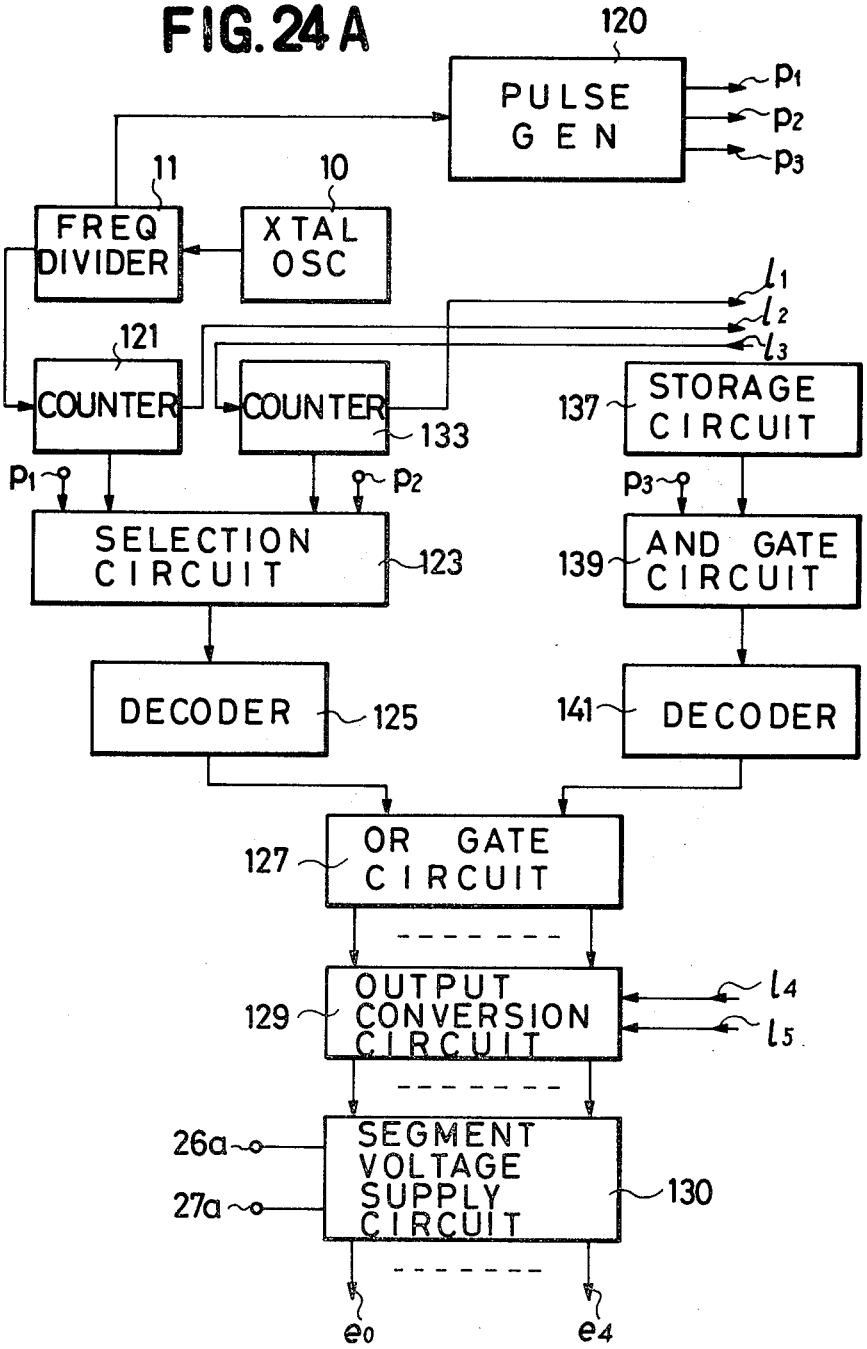
FIGS. 24A and 24B are block diagrams of circuits for driving the display of FIG. 23.
Figure 24B:
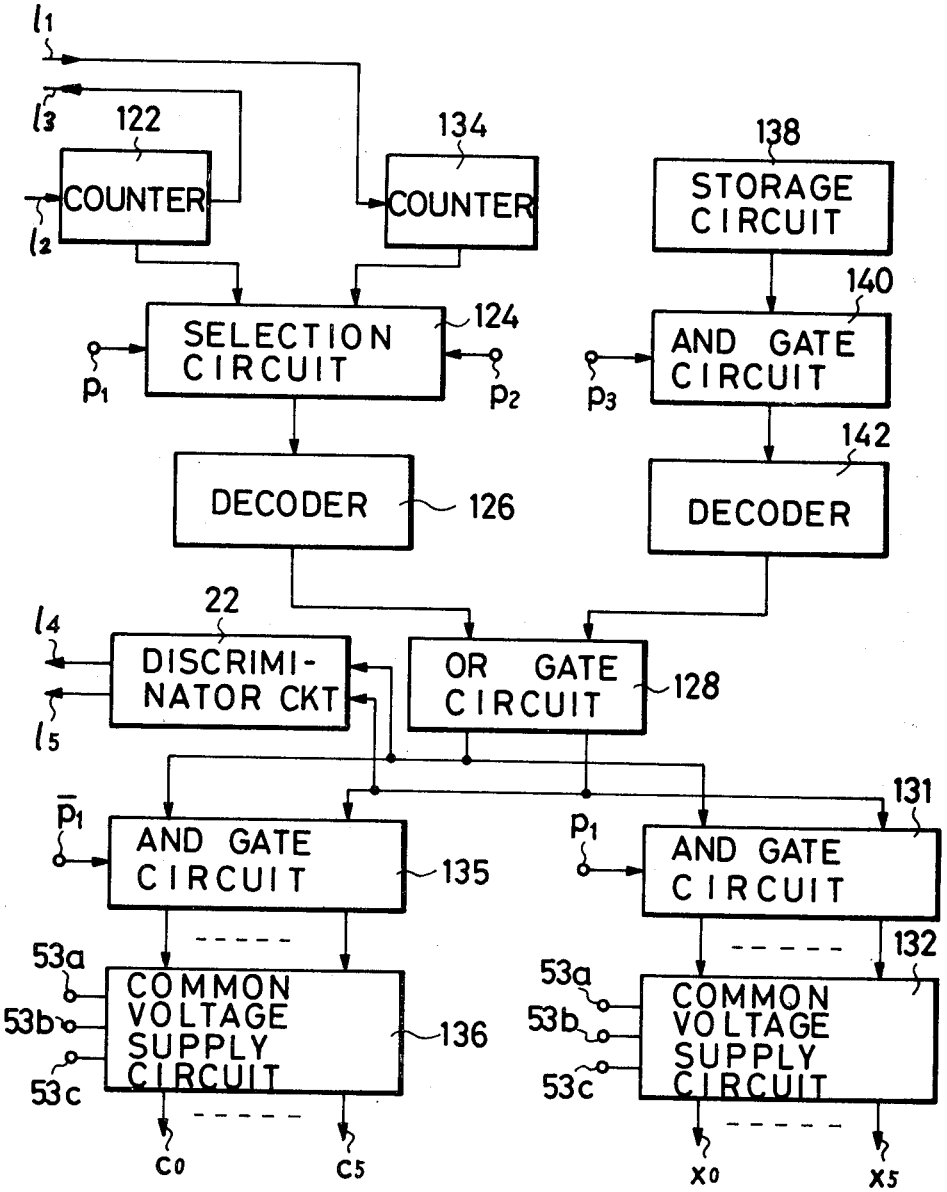

FIGS. 24A and 24B illustrate circuits for effecting the display, in which reference numeral 120 denotes a pulse generator which successively produces at the terminals $P_1$, $P_2$ and $P_3$ to display, in a time-divisional manner, remaining minutes and seconds and a preset time. Reference numerals 121 and 122 denote counters of the orders of seconds and tens of seconds of the remaining time. Responsive to the pulses generated at the terminal $P_1$, the outputs of the counters 121 and 122 pass through selection circuits 123 and 124, and are fed to decoders 125, 126 for cumulative display.

Reference numerals 127, 128 denote OR gate circuits. The output of the selection circuit 123 is fed to a segment voltage supply circuit 130 via an output conversion circuit 129. The output of the decoder 126, on the other hand, passes through the OR gate circuit 128 and an AND gate circuit 131, and is fed to a common voltage supply circuit 132 which is constructed in the same manner as that of FIG. 14. Owing to the output of common voltage supply circuit 132 and the output of the segment voltage supply circuit 130, the remaining seconds are displayed in a cumulative manner by the outer display elements as shown in FIG. 23. Here, the same reference numerals as those of the drive circuits in the preceding embodiments denote the same blocks having the same functions.

As the pulses are periodically generated from the terminal $P_2$, the outputs of the counters 133, 134 for remaining minutes are selected, and are fed to the decoders 125, 126 for cumulative display. The output of the decoder 126 is fed to the common voltage supply circuit 136 via the OR gate circuit 128 and the AND gate circuit 135. Responsive to the output of the common voltage supply circuit 136 and the output of the segment voltage supply circuit 130, the inner display elements display the remaining minutes in a cumulative manner.

As the pulses are produced from the terminal $P_3$ of the pulse generator 120, the outputs of storage circuits 137, 138 pass through AND gate circuits 139, 140, and are fed to decoders 141, 142 which are constructed in the same manner as the decoders 20, 21 of FIG. 5. The output of the decoder 142 is fed to the common voltage supply circuit 136 via the OR gate circuit 128, and the AND gate circuit 135. Therefore, responsive to the outputs of the segment voltage supply circuit 130, and the common voltage supply circuit 136, the inner display element corresponding to the preset time is turned on.

The remaining seconds may be displayed by cumulatively turning on the outer display elements while flashing them at a period of one second.

Furthermore, the present invention is in no way limited to the aforementioned embodiments only, but may be modified in a variety of other ways.

Thus, according to the present invention by which the preset time and the remaining time are simultaneously displayed in an analog manner, it is easy to recognize at a glance the preset time, the remaining time and the lapse of time. Furthermore, relations among these times can be discriminated at a glance, without needing the display of a plurality of series. Consequently, the device can be simply constructed.

What is claimed is:

1. An electronic timer, comprising:

a display comprised of a plurality of elongate segment electrodes arranged side by side in a generally circular array with the respective segment electrodes disposed extended radially of said array, a plurality of sector-shaped common electrodes arranged in two concentric rings and positioned opposite and concentric with said generally circular array of segment electrodes, said sector-shaped common electrodes dimensioned to oppose equal numbers of segment electrodes for defining groups of equal numbers of inner and outer display elements each comprised of a common electrode and a segment electrode, insulating means for insulating said segment electrodes from said common electrodes, and an electro-optical display medium disposed between said segment and common electrodes for responding to electrical signals applied to pairs of said electrodes defining display elements to change visual appearance so as to display information;

electrically conductive circuit paths connecting corresponding ones of said segment electrodes within each group of segment electrodes facing a different common electrode;

storage means for storing signals representing any desired preset time;

counting means for counting the lapse of time and for generating output signals representing the counted lapse of time;

display driving means responsive to selection signals for applying voltage pulses to said display elements for turning on and off respective ones of said display elements selected according to the selection signals;

first selection means responsive to the content of said storage means for applying to said display driving means selection signals effective to operate respective ones of said display elements for displaying the preset time represented by the contents of said storage means; and second selection means responsive to the count developed by said counting means for applying to said display driving means selection signals effective to operate respective ones of said display elements for displaying a lapse of time relative to the preset time.

2. An electronic timer according to claim 1, further comprising third selection means for applying to said display driving means selection signals effective for operating said display means to enable at least one display element to indicate that time remaining to the preset time is zero.

3. An electronic timer according to claim 1, wherein:

said first selection means comprises means for applying to said display driving means selection signals effective to operate said display driving means to enable at least one of said inner and outer display elements to display the preset time; and said second selection means comprises means for generating selection signals effective to operate said display driving means to turn on respective ones of said inner display elements for operating an inner area of said display corresponding to the time remaining to the preset time.

4. An electronic timer according to claim 1, wherein:

said first selection means comprises means for generating selection signals to operate said display driving means to enable at least one of said inner and outer display elements to display the preset time; and said second selection means comprises means for generating selection signals to operate said display driving means to turn on respective ones of said outer display elements for operating an outer area of said display corresponding to the time remaining to the preset time.

5. An electronic timer according to claim 1, wherein:

said first selection means comprises means for generating selection signals to operate said display driving means to enable at least one of said inner and outer display elements to display the preset time; and said second selection means comprises means for generating selection signals to operate said display driving means to turn on respective ones of said inner display elements and respective ones of said outer display elements for operating inner and outer areas of said display corresponding to the time remaining to the preset time.

6. An electronic timer according to claim 5, wherein:

said second selection means comprises means for generating selection signals effective to operate said display driving means to display remaining minutes with said inner display elements and to display remaining seconds with said outer display elements.

7. An electronic timer, comprising:

a display comprised of a plurality of elongate segment electrodes arranges side by side in a generally circular array with the respective segment electrodes disposed extending radially of said array, a plurality of sector-shaped common electrodes arranged in two concentric rings and positioned opposite and concentric with said generally circular array of segment electrodes, said sector-shaped common electrodes dimensioned to oppose equal numbers of segment electrodes for defining groups of equal numbers of inner and outer display elements each comprised of a common electrode and a segment electrode, insulating means for insulating said segment electrodes from said common electrodes, and an electro-optical display medium disposed between said segment and common electrodes for responding to electrical signals applied to pairs of said electrodes defining display elements to change visual appearance so as to display information;

electrically conductive circuit paths connecting corresponding ones of said segment electrodes within each group of segment electrodes facing a different common electrode;

counting means for counting the lapse of time and for generating output signals representing the counted lapse of time;

storage means for storing signals representing any desired preset time;

selecting means for alternately selecting signals stored by said storage means representing a preset time and counting means output signals representing the counted lapse of time;

first driving means responsive to the signals selected by said selecting means for applying voltage pulses to respective segment electrodes and common electrodes for turning on display elements to display the times represented by said selected signals; and second driving means responsive to the signals selected by said selecting means for applying voltage pulses to respective segment electrodes and common electrodes for turning off display elements not necessary to display the times represented by said selected signals.

8. An electronic timer according to claim 7, wherein said counting means comprises means for operating in a count down mode.

* * * * *